US008319164B2

(12) United States Patent
Martinez

(10) Patent No.: US 8,319,164 B2
(45) Date of Patent: Nov. 27, 2012

(54) ROLLING PROJECTILE WITH EXTENDING AND RETRACTING CANARDS

(75) Inventor: Marcelo Edgardo Martinez, Cordoba (AR)

(73) Assignee: Nostromo, LLC, Alexandria, VA (US)

( * ) Notice: Subject to any disclaimer, the term of this patent is extended or adjusted under 35 U.S.C. 154(b) by 213 days.

(21) Appl. No.: 12/912,252

(22) Filed: Oct. 26, 2010

(65) Prior Publication Data

US 2011/0297783 A1 Dec. 8, 2011

Related U.S. Application Data

(60) Provisional application No. 61/254,840, filed on Oct. 26, 2009.

(51) Int. Cl.
*F42B 15/01* (2006.01)

(52) U.S. Cl. ..... 244/3.27; 244/3.21; 244/3.24

(58) Field of Classification Search ..... 244/3.27, 244/3.21, 3.24
See application file for complete search history.

(56) References Cited

U.S. PATENT DOCUMENTS

| | | | | |
|---|---|---|---|---|
| 3,154,015 | A * | 10/1964 | Muller | 244/3.21 |
| 4,037,806 | A * | 7/1977 | Hirsch et al. | 244/3.21 |
| 4,113,204 | A * | 9/1978 | Leek | 244/3.21 |
| 4,512,537 | A * | 4/1985 | Sebestyen et al. | 244/3.21 |
| 5,439,188 | A * | 8/1995 | Depew et al. | 244/3.21 |
| 5,669,581 | A | 9/1997 | Ringer | |
| 5,816,531 | A | 10/1998 | Hollis et al. | |
| 5,826,821 | A | 10/1998 | Brandon et al. | |
| 5,829,715 | A * | 11/1998 | Banks | 244/3.27 |
| 6,502,786 | B2 * | 1/2003 | Rupert et al. | 244/3.27 |
| 6,588,700 | B2 * | 7/2003 | Moore et al. | 244/3.27 |
| 6,666,402 | B2 * | 12/2003 | Rupert et al. | 244/3.27 |
| 6,748,871 | B2 * | 6/2004 | Hellman | 244/3.27 |
| 6,883,747 | B2 * | 4/2005 | Ratkovic et al. | 244/3.15 |
| 6,886,774 | B2 * | 5/2005 | Lamorlette | 244/3.15 |
| 7,147,181 | B2 * | 12/2006 | Selin et al. | 244/3.27 |
| 7,163,176 | B1 * | 1/2007 | Geswender et al. | 244/3.27 |
| 7,354,017 | B2 * | 4/2008 | Morris et al. | 244/3.15 |
| 7,533,849 | B2 * | 5/2009 | Zemany et al. | 244/3.21 |
| 7,631,833 | B1 * | 12/2009 | Ghaleb et al. | 244/3.15 |
| 7,718,937 | B1 * | 5/2010 | Dunn et al. | 244/3.21 |
| 7,834,300 | B2 * | 11/2010 | Zemany et al. | 244/3.15 |
| 2004/0108412 | A1 * | 6/2004 | Moore et al. | 244/3.24 |
| 2007/0241227 | A1 * | 10/2007 | Zemany et al. | 244/3.1 |
| 2008/0006736 | A1 * | 1/2008 | Banks | 244/3.21 |
| 2008/0029641 | A1 * | 2/2008 | Carlson et al. | 244/3.24 |
| 2010/0314489 | A1 * | 12/2010 | Buckland et al. | 244/3.27 |

FOREIGN PATENT DOCUMENTS

WO 2008143707 A2 11/2008

* cited by examiner

*Primary Examiner* — Michael Carone
*Assistant Examiner* — Steven Hawk
(74) *Attorney, Agent, or Firm* — Karl F. Milde, Jr.; Eckert Seamans Cherin & Mellot, LLC

(57) ABSTRACT

A slow rolling projectile comprises a projectile body has a forward section and a rear section and having a longitudinal axis. Two or more canards in the forward section are capable of being extended from and retracted into the projectile body at predetermined frequencies and/or for predetermined times. Two or more tail fins in the rear section are fixed coextensive to or at an angle to the longitudinal axis, and an actuator extends and retracts the canards. The canards are capable of being extended and retracted at a rate based on the rotation of the projectile sufficient to correct for lateral movement. A GPS or INS navigational system activates an actuator to extend and retract the canards.

8 Claims, 4 Drawing Sheets

ROLLING PROJECTILE WITH EXTENDING AND RETRACTING CANARDS

CROSS-REFERENCE TO RELATED APPLICATION

This application is based upon and claims the priority of commonly assigned U.S. Provisional Patent Application Ser. No. 61/254,840, filed Oct. 26, 2009, incorporated herein in its entirety by reference.

FIELD OF THE INVENTION

This invention is directed to a system for controlling missiles or projectiles, where canards extend and retract at predetermined frequencies.

BACKGROUND OF THE INVENTION

In the field of guided weapons there are primarily two possible aerodynamically controlled airframes, namely, a rolling airframe and a roll stabilized airframe. These two schemes cover most of the missiles and projectiles with aerodynamic controls.

A missile or projectile with a rolling airframe has an airframe that is free to roll or its rolling motion is controlled by a device (such as a rolleron) to keep the roll rate at a certain value. Aerodynamic controlled deflections can then be coordinated with the roll position, which is calculated by roll-resolvers using roll gyros. A typical example is the Sidewinder missile, which uses four steering canards.

Another embodiment of the rolling airframe uses only one pair of aerodynamic control surfaces and deflects them in a proper position to satisfy the guidance and control vector demand.

General Dynamics pioneered several new design features to create the Redeye missile, which was the first rolling airframe missile (RAM). Unlike conventional roll stabilized missiles which are steered in two axes, pitch and yaw, by two (pitch, yaw) control channels, a RAM uses a single control channel which is "phased" to introduce pitch and yaw commands subject to the missile's instantaneous orientation (roll angle) in roll. In this fashion a single pair of control surfaces can do the work of two pairs of control surfaces, reducing weight and space requirements with some penalty in maneuver performance. General Dynamics applied further new technology to the Redeye missile by designing all of the guidance and control electronics with solid state transistor and integrated circuit technology, a first in tactical missiles. Another major weight saving measure was the use of electrical control actuators to displace bulkier conventional hydraulics. Internal wiring harnesses in the missile were replaced with lighter, flexible, flat printed wiring harnesses.

Two schemes of control by a single pair of deflecting canards have been used in RAM missiles. In one of the schemes, the canards generate the lift forces by deflecting the canards by a certain angle by an actuator according to the roll position and the lift required to generate the lateral acceleration to change the trajectory angle. In the other scheme, referred to as "Dithering Canards," the canards, once deployed, vibrate or dither at some frequency in the rolling airframe to create the appropriate lateral force to steer the missile or projectile.

Dithering canards are simpler than deflectable canards with specific angles of deflection because it is not necessary to have a complex servomechanism to deflect them. However, the dithering canard scheme needs to be packed and then deployed after launch, which usually makes the mechanical design complex.

Seeking simplicity and low cost solutions to be used in the control of guided mortar projectiles, General Dynamics found a solution with the so-called roll controlled fixed canard (RCFC) system, as set forth in U.S. Pat. No. 7,354,017 to Morris et al. The RCFC system is an integrated fuze and guidance- and flight-control system that uses global positioning system (GPS) and/or inertial navigational system (INS) navigation and that is installed by replacing current fuze hardware in existing mortars or other projectiles. A typical projectile having the RCFC system comprises:

(a) a nose section with a guidance package, a set of spinning strakes, and a set of two fixed deflected canards;

(b) a brake unit section, with a brake system (friction or magneto rheological fluid), to modulate the spin of the guidance section with the projectile body and stabilizing fins; and (c) a projectile body with multiple canted fins.

The projectile is designed to couple and decouple the two sections (nose and main) that can rotate in different directions with variable spin rates, or rotate as a single body, dependent upon the braking force. If the rotation rate is close to zero in the reference frame, the fixed deflected canards will trim the projectile and generate lateral normal force, which will steer the projectile in the desired or demand vector requested by the guidance system (for example, GPS or INS). However, this system is quite complex and not practical for many projectiles.

Another concept to create trajectory correction to artillery projectiles is disclosed in PCT Published Application No. WO 2008/143707 to Pritash. Trajectory errors can be corrected in two ways: Assuming an overshoot, a deployable set of brake fins or disks is used to correct the range errors. This assumes that the target is at a range shorter than at which the weapon is aimed, because it only can waste kinetic energy by braking the projectile by the use of aerodynamic brakes.

A deflection correction is based on the fact that a very fast spinning projectile will divert (drift) to one side depending of the roll motion direction, and therefore changing the roll rate changes the amount of the lateral drift. The spin correction fins of Pristash do exactly this by extending or retracting spin fins which are at fixed incidence but in opposite directions. The spin rate, and hence the deflection, is controlled. However, the gun or weapon must be aimed in a specific direction prior to shooting so that by changing the spin rate and braking the velocity over the trajectory, the desired target can be hit.

Similar to the control system discussed above, this system is much more complex than is needed for slow rolling projectiles.

SUMMARY OF THE INVENTION

It is an object of this invention to provide a novel system for controlling missiles or projectiles, which is simpler and less expensive than the systems described above.

It is also an object of this invention to provide a rolling projectile with extending and retracting canards.

It is a further object of this invention to provide missiles or projectiles where canards extend and retract for times and at predetermined frequencies corresponding to the rate of rotation of the projectile.

It is a yet further object of this invention to provide a projectile comprising:

a projectile body having a forward section and a rear section and having a longitudinal axis;

two or more canards in the forward section on opposite sides of the projectile that are capable of being extended and retracted for times and at frequencies corresponding to the rate of rotation of the projectile;

two or more tail fins in the rear section that are fixed coextensive to or at an angle to the longitudinal axis; and an actuator capable of extending and retracting the canards, wherein after the projectile is fired along a path, the canards are extended from and retracted into the projectile body for times and at frequencies related to rotation of the projectile to correct the path of the projectile.

It is a yet further object of the invention that the projectile or missile will have a GPS or INS navigational system that will be in operative communication with the canards in the forward section.

These and other objects of the invention will become more apparent from the disclosure herein.

According to the invention, a cost-effective 2 or 3 DOF steering system, when coupled with a GPS or INS navigation system, provides course correction to improve the targeting precision of mortars, bombs, artillery projectiles and missiles. In one aspect of the invention, tail fins to produce rotation are provided, which tail fins cause the projectile to slowly roll in flight. A flight control system comprises canards that extend and retract for times and at predetermined frequencies on the forward end of the projectile.

The flight control system is attached to or incorporated within the body of the projectile. During projectile flight, the flight control system measures the projectile's position (using GPS or INS technology), and then the flight control system, which includes sensors, initiates flight control actuators that precisely extend and retract the canards.

As the projectile rotates, the relative rotational position and canard extension (from the projectile body) varies as an actuator controls the positional extension of the canards. The controlled extension and retraction of the canards varies the lift on the forward, leading edge of the projectile fuze. The resulting variation of lift on the forward point of the fuze provides for variation of the angle of attack on the nose and forward canards. This system provides a low g correction of the projectile's path.

According to the invention, the simplicity of the RCFC concept (only one signal to steer the projectile using the brake system) is maintained, but it is coupled with the fixed incidence of extending and retracting canards using only one linear actuator while the complete airframe is rolling by the use of canted tail fins. In both concepts, the rolling motion is required to obtain the lateral force vector in the desired direction due to only one pair of canards being present. Roll motion is not produced to create gyroscopic stability, nor to control the spin rate to use the gyroscopic drift as lateral force producer.

Thus, a slowly rolling projectile, when coupled with a GPS or INS navigational system, provides course correction to improve the precision of mortars, bombs, artillery projectiles, and missiles.

The steering system according to the invention includes tail fins, canards, a GPS and/or INS navigational system, a flight control computer, and an interface to the fuze and projectile or missile body. Tail fins are placed at an angle to the longitudinal axis that induces rotation and creates a slowly rolling projectile in flight. On the forward end of the projectile the steering system includes extending and retracting canards. The steering system is fixed to the projectile body. The canards are planar and preferably canted at a fixed angle to the longitudinal axis, and they are at fixed incidence.

During projectile flight the GPS and/or INS navigational system measures the projectile's position, and the flight control computer initiates flight control actuators that precisely extend and retract the canards. The controlled extension and retraction of the canards varies the lift on the nose or fuze of the projectile. The resultant variation in lift on the nose or fuze of the projectile provides a trim angle of attack of the entire projectile, which produces a lateral force that steers the projectile into a desired path to correct the errors such as variation of muzzle velocity, mortar laying errors, and meteo.

The current requirements for precision fires and minimum collateral damage for the actual battlefield requires low cost solutions for control devices to be applied in smart weapons. Mortar projectiles with correction systems based on low cost GPS/INS meet these requirements.

The current trend in the case of low cost guided or corrected mortar munitions is characterized by the following requirement matrix:

low cost;

fire and forget;

corrected trajectory to minimizing nominal trajectory errors;

GPS/INS navigation compatible with desired weapon CEP and Pk; and capability to engage targets in zone of impact Desired features of the system could be described as follows:

1. Increased effectiveness and efficiency of mortar weapons, where the CEP is drastically reduced, the logistics are reduced, and the OPTEMPO is increased.
2. Large existing mortar projectile stocks/current unguided mortar development can be used. This includes existing bodies/tails and fuzes.
3. The corrector must still be a fuze that is easy to install and program and is hardy enough for field handling.

The control and guidance system disclosed and claimed herein has the following advantages:

1. Flip-out fixed incidence planar canards (two canards).
2. One single electromechanical actuator.
3. LATAX demanded by the guidance system tuned with flip-out frequency and/or canard aperture.
4. Rolling driven moment produced by canted tail/nose fins.
5. Static pitch stability that is not strongly affected by forward canards' aero-surfaces, where the static stability is decreased with canard exposure, thus increasing the trim angle, to cause lateral acceleration.

A particularly relevant aspect of the invention herein is that it is a simple way to generate control forces in mortar projectiles, using a device which can be integrated with a fuze, can be armed in a system at low cost, and is compatible with current developments in GPS/INS guidance packages of these types of smart projectiles.

Preset aiming is not necessary according to the invention, because in both cases the gun/weapon will be aimed at the intended target and the ballistic computations will determine the errors of the calculated nominal trajectory, which will be compensated by the guidance and control system extending and retracting canards in a rolling airframe.

For a full understanding of the present invention, reference should now be made to the following detailed description of the preferred embodiments of the invention as illustrated in the accompanying drawings.

DETAILED DESCRIPTION OF THE INVENTION

Figure 1:
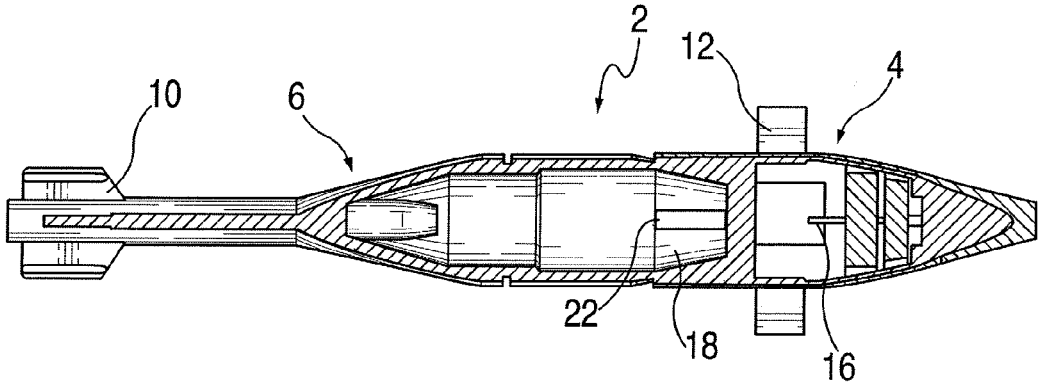
FIG. 1 is a substantially cross-sectional view of a schematic of an embodiment of the invention wherein canards are extended.

The preferred embodiments of the present invention will now be described with reference to FIGS. 1 to 8 of the drawings. Identical elements in the various figures are designated with the same reference numerals.

Figure 2:
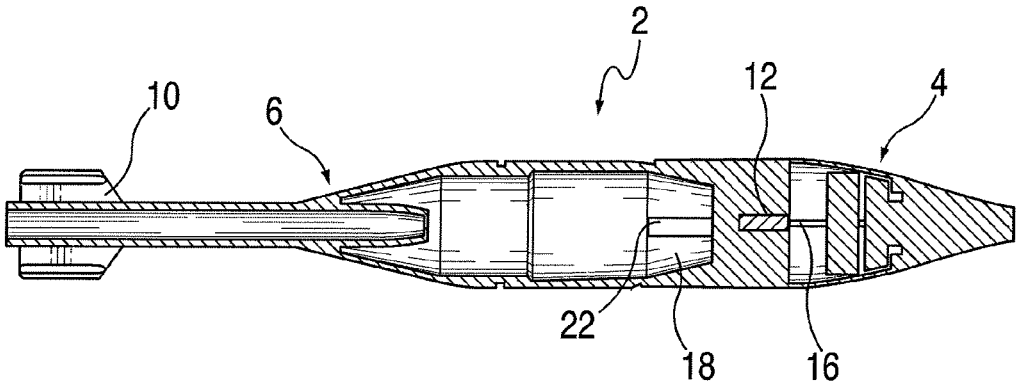
FIG. 2 is a substantially cross-sectional view of a schematic in FIG. 1 wherein the canards are retracted.

FIGS. 1 and 2 are each a substantially cross-sectional representation of a mortar according to the invention. A mortar 2 has a front, or fuze, section 4 and a rear section 6. Rear section 6 comprises tail fins 10, which tail fins 10 are proportional and angled to stabilize mortar 2 in flight as well as to cause a slight roll.

Front section 4 comprises canards 12 that extend or retract from housing 14. Canards 12 are shown extended in FIG. 1 and retracted in FIG. 2. Canards 12 are engaged by one or more actuators 16, which are in communication with a flight control system 18. Flight control section 18 comprises a navigational system such as a GPS or INS and, preferably, a CPU. Preferably there is a battery or other power source 22 to provide power to flight control system 18 and actuator 16.

Preferably there are two canards 12. Optimally there could be from 2 to 8 canards, preferably equidistantly positioned around housing 14.

The size of the canards will depend upon several factors, including the sign of the projectile. For example, for a mortar having a length of from about 0.5 to almost 1.5 m, the canards could each be from about 10 to about 50 cm in width and about 10 to about 50 cm in length, the surface area extending radially from the outer surface of housing 14.

Figure 3:
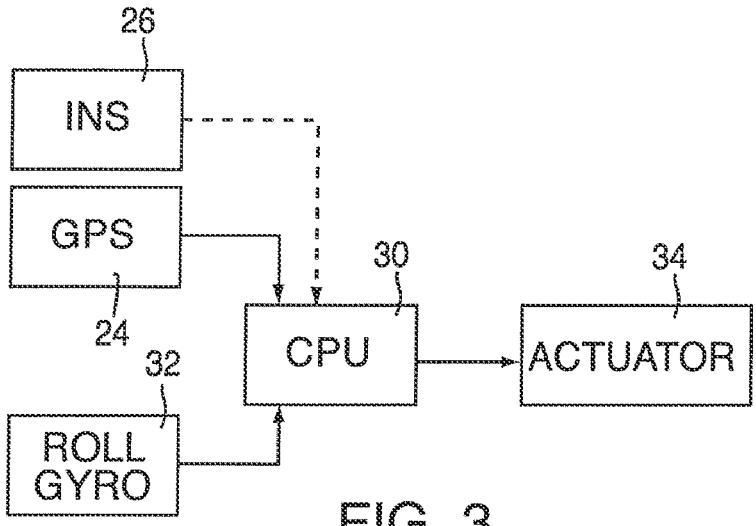
FIG. 3 is a block diagram representing the control system according to the invention.

The control system according to the invention is shown in the block diagram set forth in FIG. 3. A GPS 24 and an INS 26, INS 26 being optional, each communicate signals reflecting location information to a CPU 30. A roll gyro 32 communicates roll information, for example, roll angle and angular velocity, to CPU 30. CPU 30 processes the location and roll information and then, when appropriate, sends signals to actuator 34.

Actuator 16 or 34 is an electrical or mechanical device that causes one or both canards 12 to extend or retract as desired, preferably for times and/or at frequencies that correspond to the rate of rotation of the projectile. For example, the canards may extend from the housing once per cycle, that is, once per rotation of the projectile, for from one-third to one-half the cycle, the timing dependent upon the rotation and the correction necessary. There may be situations where the canards can extend and retract more than once a cycle, or less than every cycle, or for most or all of a cycle, dependent upon the correction required. There may be one particular frequency at which the actuator operates or, optionally, the frequency may vary according to signals from flight control system 18. It is within the scope of the invention that the frequency of the extension and retraction of the canards will be from about 2 to about 20 times/sec., more preferably from about 5 to about 10 times/sec. Optionally canards 12 may be extended partially or fully and not retracted for a set period of time.

Figure 4:
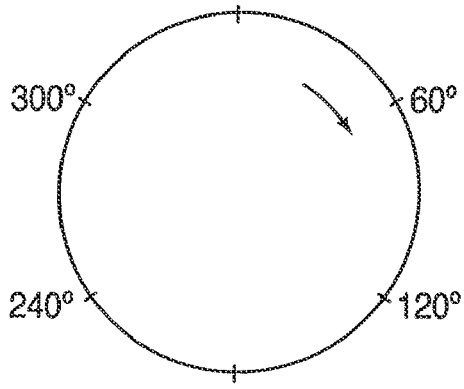
FIG. 4 is a representation of the projectile rotation according to the invention, showing the positions at which the canards are extended and retracted.

Typically the canards will be extended once and retracted once during one rotation of a projectile. The diagram shown in FIG. 4 represents one 360° rotation of a projectile. If the projectile is to be guided to the right, both canards are extended from its surface when the projectile rotates to a position approximately 60° from the top position. The canards remain partially or fully extended as the projectile rotates to an angle of 120°, and are then retracted. If the projectile is to be guided to the left, the canards are extended during the period that it rotates between angles in the range of 240° to 300°, at which time the canards again retract. Retraction is complete as the projectile rotates to 300°. This can be repeated, or varied, for each rotation of the projectile, dependent upon the correction required.

Figure 5:
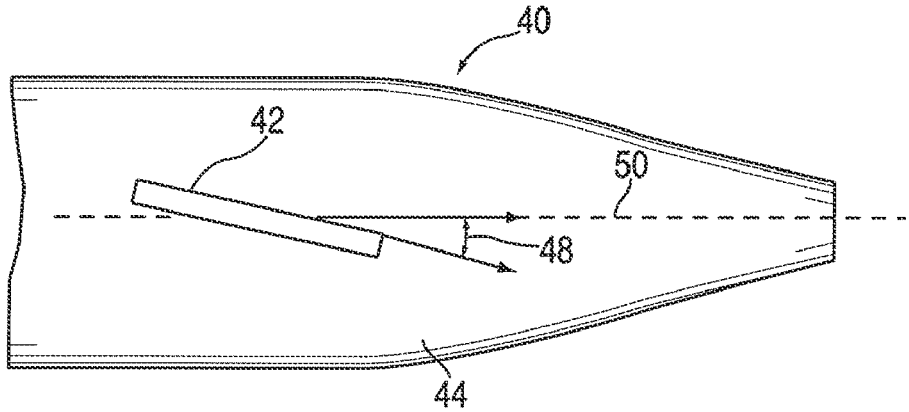
FIG. 5 is a side view of the forward portion of a projectile according to the invention.

In FIG. 5, a forward section 40 of a projectile has a canard 42 that is radially extended from a housing 44 of forward section 40. Canard 42 is at an angle 48 to longitudinal axis 50. Angle 48 can be from about 2° to about 20°, preferably from about 4° to about 10°, more preferably about 5°.

EXAMPLE

In a calculated example of an embodiment of the invention, a mortar with a mass of 4.40 kg was fired at an initial angle of 45° with a velocity of 300.00 m/sec. The rotational frequency was 8.00 Hz, at the maximum lateral acceleration.

The time of the flight was 36.40 sec, the range being 5506.0 m. The maximum height was 1640.30 m, at which point the velocity of the projectile was at a minimum of 147.24 m/sec. This occurred 19.50 sec after launch. The velocity at impact was 194.76 m/sec, at an angle of 54.73°. The maximum lateral correction was calculated at 233.69 m.

Figure 6:
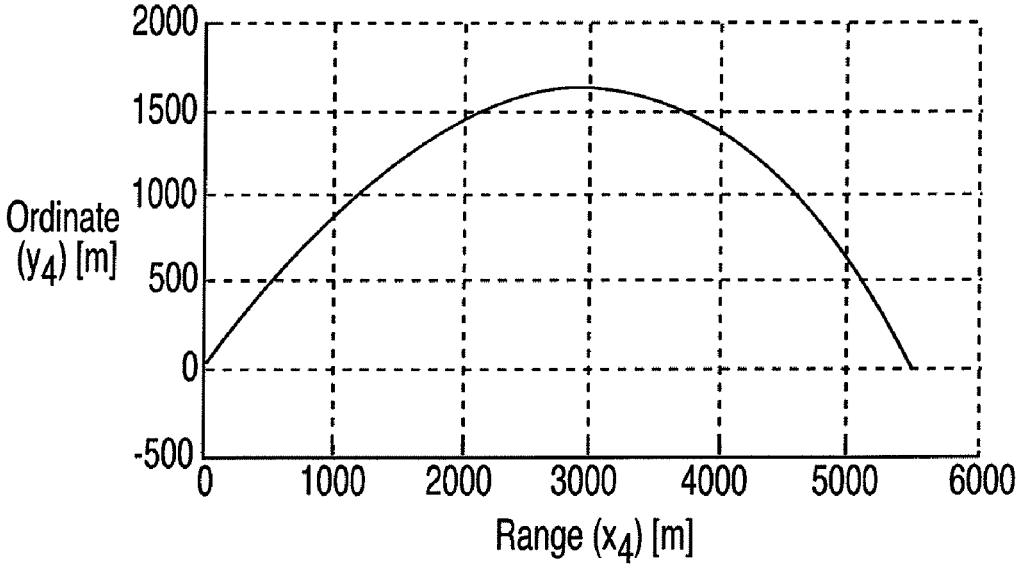
FIG. 6 is a graph of the path of a projectile from launch to impact, with height in the ordinate and distance in the abscissa.
Figure 7:
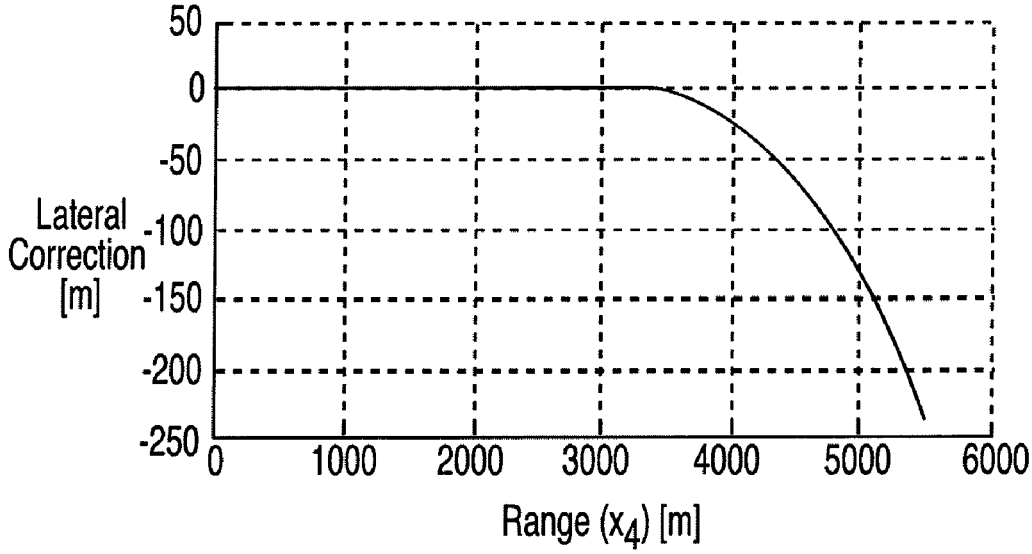
FIG. 7 is a graph of the path of the projectile in FIG. 3 where the calculated correction is shown as a function of distance.
Figure 8:
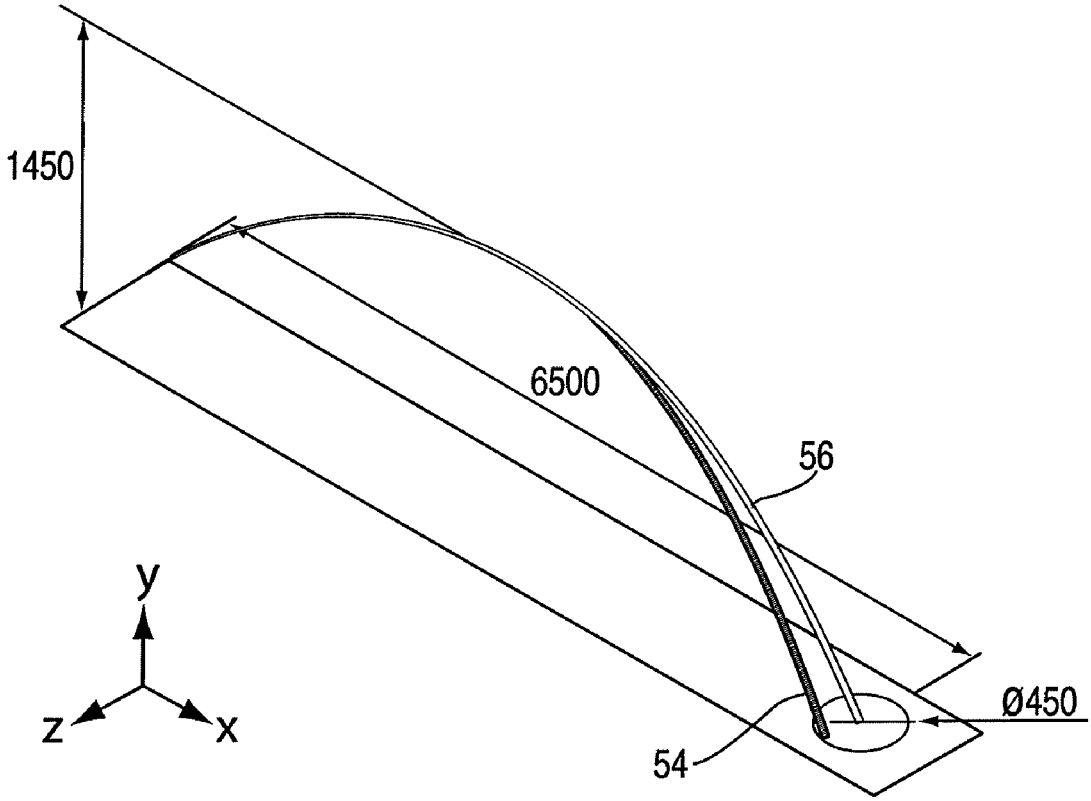
FIG. 8 is a schematic representation of the corrected and uncorrected projectile paths.

FIG. 6 is a graph that represents the height of the path of the projectile from launch to impact, without canards extended. FIG. 7 is a graph that represents the amount of lateral correction necessary. FIG. 8 is a 3-dimensional representation that represents the uncorrected path 54 of the projectile as compared to a corrected path 56 with corrections according to the invention.

There has thus been shown and described a novel rolling projectile with extending and retracting canards, particularly one which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A projectile comprising:

a projectile body having a forward section and a rear section and having a longitudinal axis;

two or more canards, arranged in the forward section on opposite sides of the projectile body and disposed at an angle with respect to the longitudinal axis, that are capable of being extended from and retracted into the projectile body for times and at frequencies corresponding to a rate of rotation of the projectile;

two or more tail fins affixed to the rear section of the projectile body at an angle with respect to the longitudinal axis to stabilize the projectile body and cause continuous rotation thereof about its longitudinal axis while in flight, and an actuator arranged in the projectile for extending and retracting the canards in synchronism with the rotation of the projectile body, wherein, after the projectile is fired along a path, the canards are extended from and retracted into the projectile body for times and frequencies related to rotation of the projectile to laterally steer the forward section of the projectile body and correct the lateral path of the projectile.

2. The projectile of claim 1, wherein the canards are extended and retracted at a frequency of at least once every rotation of the projectile.

3. The projectile of claim 1 which also comprises a control system that activates the actuator to extend and retract the canards.

4. The projectile of claim 3, wherein the control system includes a GPS navigational system or an INS navigational system, or both, for determining the location in space of the projectile.

5. The projectile of claim 4 wherein the control system includes a roll gyro system for determining the angular position of the projectile.

6. The projectile of claim 1, where the canards are at an angle of from about 2° to about 20° from the longitudinal axis.

7. The projectile of claim 6, where the canards are at an angle of from about 4° to about 10° from the longitudinal axis.

8. The projectile of claim 7, where the canards are at an angle of from about 5° from the longitudinal axis.

* * * * *